US010278891B2

(12) United States Patent
Cheng

(10) Patent No.: US 10,278,891 B2
(45) Date of Patent: May 7, 2019

(54) AUTOMATIC SKIN TYPE DETECTING ELECTRONIC DEVICE AND METHOD FOR SKIN CARE

(71) Applicant: HON HAI PRECISION INDUSTRY CO., LTD., New Taipei (TW)

(72) Inventor: Shu-Wen Cheng, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 761 days.

(21) Appl. No.: 14/797,387

(22) Filed: Jul. 13, 2015

(65) Prior Publication Data

US 2016/0310355 A1 Oct. 27, 2016

(30) Foreign Application Priority Data

Apr. 22, 2015 (CN) ..... 2015 1 0192498

(51) Int. Cl.
*A61H 23/02* (2006.01)

(52) U.S. Cl.
CPC ..... *A61H 23/02* (2013.01); *A61H 2201/0176* (2013.01); *A61H 2201/5007* (2013.01); *A61H 2230/505* (2013.01); *A61H 2230/655* (2013.01)

(58) Field of Classification Search
CPC ..... A61H 2201/01; A61H 201/50; A61H 2230/50; A61H 2230/65
See application file for complete search history.

(56) References Cited

U.S. PATENT DOCUMENTS

| | | | | |
|---|---|---|---|---|
| 9,132,058 | B2 * | 9/2015 | Imboden | A61H 19/00 |
| 9,623,225 | B2 * | 4/2017 | Zhou | A61M 35/00 |
| 9,682,007 | B2 * | 6/2017 | Barasch | A61H 19/40 |
| 9,789,295 | B2 * | 10/2017 | Zhou | A61M 35/003 |
| 9,907,439 | B2 * | 3/2018 | Sedic | A47K 7/02 |

* cited by examiner

*Primary Examiner* — Garrett K Atkinson
(74) *Attorney, Agent, or Firm* — ScienBiziP, P.C.

(57) ABSTRACT

An automatic skin type detecting electronic device and a method for skin care are provided. The method includes controlling a skin parameter detector to detect skin parameters of skin of a user, and obtaining the skin parameters detected by the skin parameter detector. According to the obtained skin parameters, a skin type is determined. According to the determined skin type and a pre-stored relation list which defines a relationship between multiple skin types and multiple vibration modes for a vibration motor, a vibration mode is determined. The vibration motor is controlled to work in the determined vibration mode to vibrate on the skin of the user.

15 Claims, 2 Drawing Sheets

AUTOMATIC SKIN TYPE DETECTING ELECTRONIC DEVICE AND METHOD FOR SKIN CARE

CROSS-REFERENCE TO RELATED APPLICATIONS

This application claims priority to Chinese Patent Application No. 201510192498.0 filed on Apr. 22, 2015, the contents of which are incorporated by reference herein.

FIELD

The subject matter herein generally relates to an electronic device and a method for skin care.

BACKGROUND

Massage from vibration is a common beauty treatment. Vibrations having different frequencies or different accelerations can have different effects on the skin.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
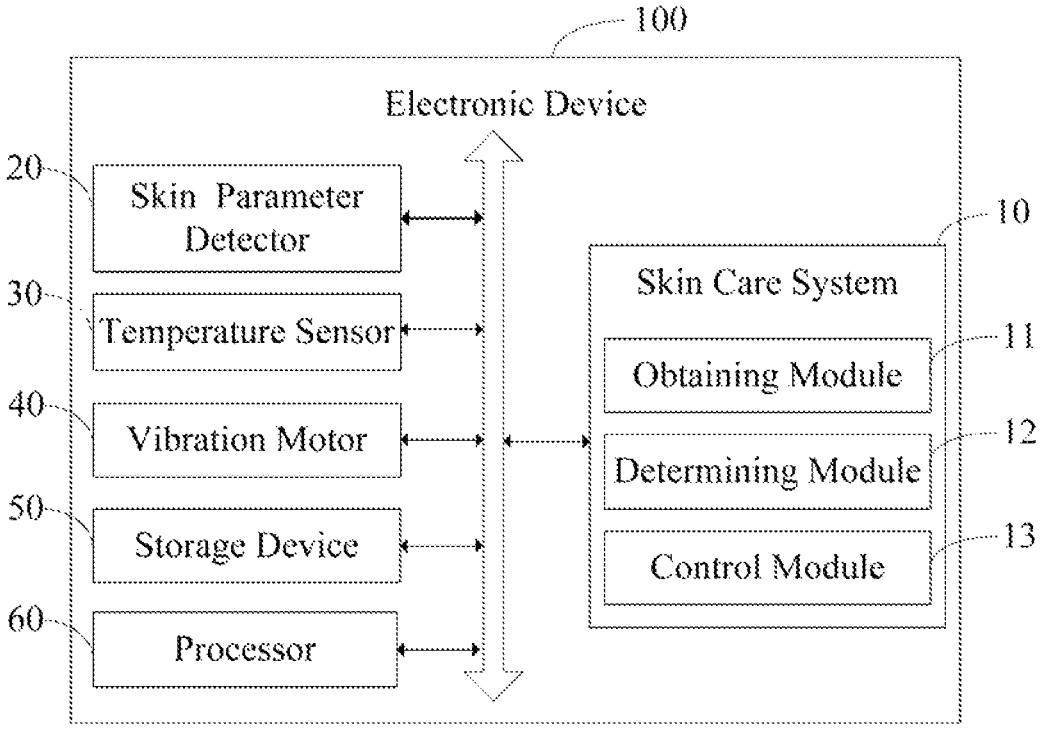
FIG. 1 is a block diagram of one embodiment of an electronic device including a skin care system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in details so as not to be considered as limiting the scope of the embodiments described herein. The drawings are not necessarily to scale and the proportions of certain parts may be exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" embodiment in this disclosure are not necessarily to the same embodiment, and such references mean "at least one".

Furthermore, the term "module", as used herein, refers to logic embodied in hardware or firmware, or to a collection of software instructions, written in a programming language, such as Java, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media includes CDs, DVDs, BLU-RAY, flash memory, and hard disk drives. The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates a block diagram of one embodiment of an electronic device. In at least one embodiment as shown in FIG. 1, an electronic device 100 includes, but is not limited to, a skin care system 10, a skin parameter detector 20, a temperature sensor 30, a vibration motor 40, a storage device 50 and at least one processor 60. FIG. 1 illustrates only one example of the electronic device 100 that can include more or fewer components than illustrated or have a different configuration of the various components in other embodiments.

In the illustrated embodiment, the skin parameter detector 20, the temperature sensor 30 and the vibration motor 40 can be mounted on the skin of a user. The skin parameter detector 20 can detect skin parameters, such as moisture, oil, or elasticity of the skin. The skin parameter detector 20 can be a moisture detector, an oil detector, an elasticity detector, or any combination thereof. In the illustrated embodiment, the skin parameter detector 20 can be built into the electronic device 100. In other embodiments, the skin parameter detector 20 can be an independent device. The temperature sensor 30 can measure temperature of the skin in real-time. The vibration motor 40 can vibrate on the skin. In the embodiment, the vibration motor 40 can be built into the electronic device 100. In other embodiments, the vibration motor 40 can be an independent device.

The storage device 50 can pre-store multiple parameter ranges, multiple skin types and a relation list which defines a relationship between multiple skin types and multiple vibration modes for the vibration motor 40. In at least one embodiment, the storage device 50 can include various types of non-transitory computer-readable storage mediums. For example, the storage device 50 can be an internal storage system, such as a flash memory, a random access memory (RAM) for temporary storage of information, and/or a read-only memory (ROM) for permanent storage of information. The storage device 50 can also be an external system, such as a hard disk, a storage card, or a data storage medium. The at least one processor 60 can be a central processing unit (CPU), a microprocessor, or other data processor chip that performs functions of the care system 10 in the electronic device 100.

The skin care system 10 can determine a skin type according to skin parameters detected by the skin parameter detector 20 and control the vibration motor 40 to work in a vibration mode corresponding to the determined skin type.

In at least one embodiment, the skin care system 10 can include an obtaining module 11, a determining module 12 and a control module 13. The function modules 11-13 can include computerized codes in the form of one or more programs, which are stored in the storage device 50. The at least one processor 60 executes the computerized codes to provide functions of the function modules 11-13.

The control module 13 controls the skin parameter detector 20 to detect skin parameters of the skin of a user. In the embodiment, the skin parameter detector 20 can be a moisture detector, an oil detector, an elasticity detector, or any combination thereof. The skin parameters can be moisture, oil, or elasticity of the skin.

The obtaining module 11 obtains the skin parameters detected by the skin parameter detector 20.

The determining module 12 determines a skin type according to the obtained skin parameters. In at least one embodiment, the determining module 12 determines a skin type according to a ratio of one skin parameter relative to another skin parameter, such as a ratio of moisture relative to oil. In the embodiment, the multiple parameter ranges include a first parameter range and a second parameter range, and the multiple skin types include a first skin type and a second skin type. If the obtained skin parameters fall into the first parameter range, the determining module 12 determines that the skin of the user belongs to the first skin type. If the obtained skin parameters fall into the second parameter range, the determining module 12 determines that the skin of the user belongs to the second skin type.

The determining module 12 queries the relation list to determine a vibration mode associated to the determined skin. In at least one embodiment, the multiple vibration modes include a first vibration mode and a second vibration mode, and the vibration frequency and the acceleration of the first vibration mode differ from the second vibration mode. The determining module 12 determines a first vibration mode if the skin of the user having the obtained skin parameters belongs to the first skin type, and a second vibration mode is determined if the skin having the obtained skin parameters belongs to the second skin type.

The control module 13 controls the vibration motor 40 to work in the determined vibration mode to vibrate on the skin of the user.

The obtaining module 11 polls the temperature sensor 30 by a preset frequency to obtain the temperature measured by the temperature sensor 30. In the embodiment, the temperature sensor 30 is mounted on the skin of the user and measures temperature of the skin in real-time.

The determining module 12 determines whether the obtained temperature is greater than a preset temperature. If the obtained temperature is greater than the preset temperature, the control module 13 controls the vibration motor 40 to stop vibrating. The preset temperature varies by the age, in at least one embodiment, the preset temperature is 37.5° C.

Figure 2:
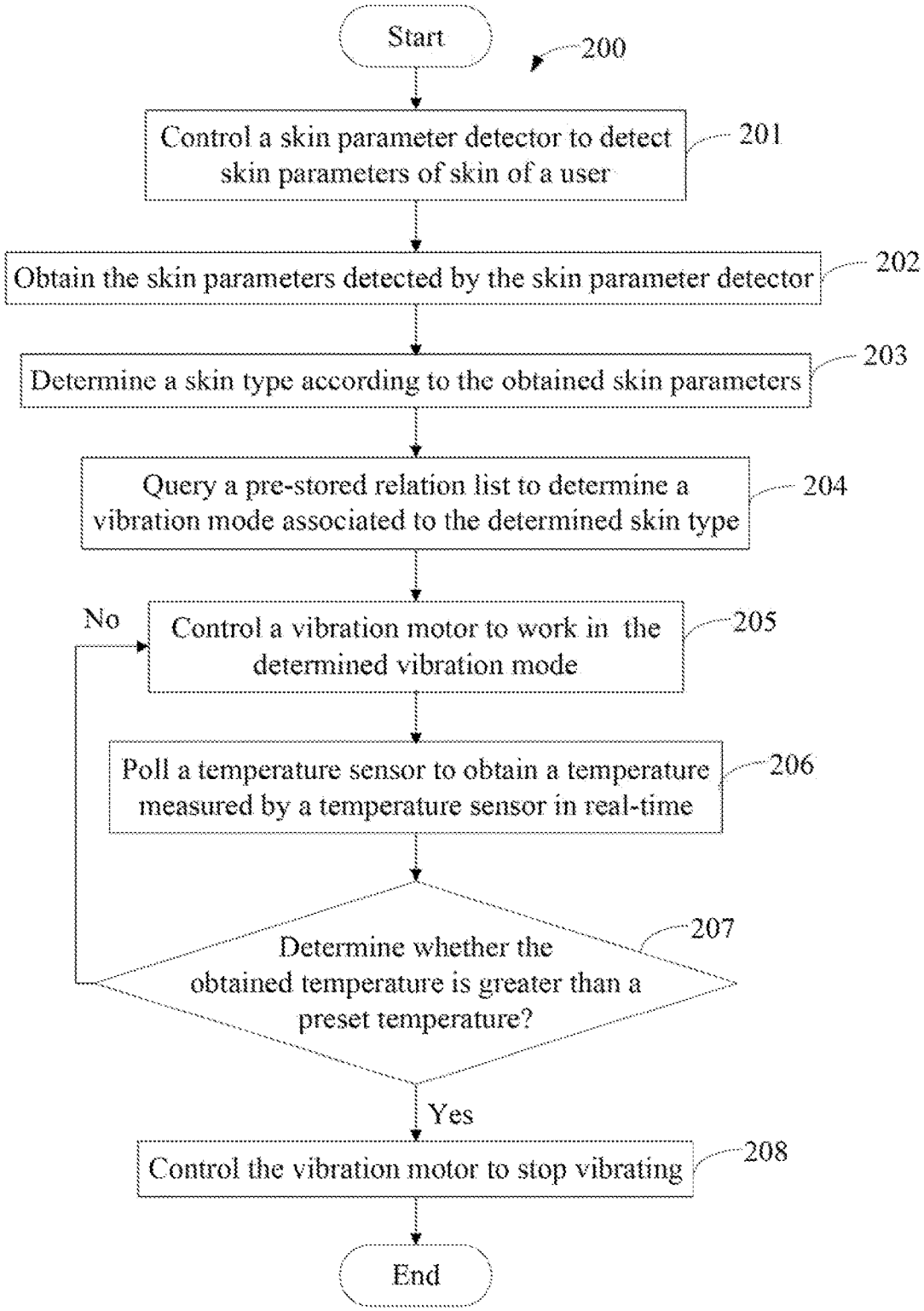
FIG. 2 illustrates a flowchart of one embodiment of a method for skin care in the electronic device of FIG. 1.

Referring to FIG. 2, a flowchart of a method for skin care is presented in accordance with an example embodiment. The example method 200 is provided by way of example, as there are a variety of ways to carry out the method. The example method 200 described below can be carried out using the configurations illustrated in FIG. 1 for example, and various elements of these figures are referenced in explaining example method 200. Each block shown in FIG. 2 represents one or more processes, methods, or subroutines carried out in the example method 200. Furthermore, the illustrated order of blocks is by example only and the order of the blocks can be changed. The example method 200 can begin at block 201. Depending on the embodiment, additional steps can be added, others removed, and the ordering of the steps can be changed.

At block 201, a control module controls a skin parameter detector to detect skin parameters of the skin of a user.

At block 202, an obtaining module obtains the skin parameters detected by the skin parameter detector.

At block 203, a determining module determines a skin type according to the obtained skin parameters of the user.

At block 204, the determining module queries a prestored relation list to determine a vibration mode associated to the determined skin type. The relation list defines a relationship between multiple skin types and multiple vibration modes for a vibration motor.

At block 205, the control module controls the vibration motor to work in the determined vibration mode to vibrate on the skin of the user.

At block 206, the obtaining module polls a temperature sensor by a preset frequency to obtain a temperature of the skin of the user measured by the temperature sensor in real-time.

At block 207, the determining module determines whether the obtained temperature is greater than a preset temperature. If the obtained temperature is greater than the preset temperature, block 208 is implemented. Otherwise, if the obtained temperature is less than the preset temperature, block 205 is implemented.

At block 208, the control module controls the vibration motor to stop vibrating.

With such a configuration, a vibration motor can be controlled to vibrate according to a vibration mode corresponding to a determined skin type.

It should be emphasized that above-described embodiment of the present disclosure including any particular embodiments, are merely examples of implementations set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. An electronic device comprising:

a skin parameter detector;

at least one processor coupled to the skin parameter detector;

a vibration motor coupled to the at least one processor; and a non-transitory storage device that stores a relation list defining a relationship between multiple skin types and multiple vibration modes for the vibration motor, and the storage device further stores one or more programs which, when executed by the at least one processor, cause the at least one processor to:

control the skin parameter detector to detect skin parameters of skin of a user, wherein the skin parameters comprise moisture, oil, and elasticity of the skin;

obtain the skin parameters detected by the skin parameter detector;

determine a skin type according to the obtained skin parameters;

query the relation list to determine a vibration mode associated to the determined skin type; and control the vibration motor to work in the determined vibration mode to vibrate on the skin.

2. The electronic device according to claim 1, wherein the at least one processor determines the skin of the user having the obtained skin parameters belongs to a first skin type if the obtained skin parameters fall into a first parameters range, and determines the skin of the user having the obtained skin parameters belongs to a second skin type if the obtained skin parameters fall into a second parameters range.

3. The electronic device according to claim 1, wherein the at least one processor determines a first vibration mode if the skin of the user having the obtained skin parameters belongs to a first skin type, and determines a second vibration mode if the skin of the user having the obtained skin parameters belongs to a second skin type.

4. The electronic device according to claim 1, further comprising a temperature sensor which is configured to measure temperature of the skin of the user in real-time, wherein the at least one processor further:

polls the temperature sensor by a preset frequency to obtain the temperature measured by the temperature sensor;

determines that the obtained temperature is greater than a preset temperature; and upon such determination, controls the vibration motor to stop vibrating.

5. The electronic device according to claim 1, wherein the multiple vibration modes define different vibration frequencies and different accelerations for the vibration motor.

6. A computer-implemented method for skin care used in an electronic device being executed by a processor of the electronic device, the method comprising:

controlling a skin parameter detector to detect skin parameters of skin of a user, wherein the skin parameters comprise moisture, oil, and elasticity of the skin;

obtaining the skin parameters detected by the skin parameter detector;

determining a skin type of the skin according to the obtained skin parameters;

querying a pre-stored relation list to determine a vibration mode associated to the determined skin type, wherein the pre-stored relation list defines a relationship between multiple skin types and multiple vibration modes for a vibration motor; and controlling the vibration motor to work in the determined vibration mode to vibrate on the skin.

7. The method according to claim 6, wherein determining a skin type of the skin according to the obtained skin parameters comprising:

determining the skin of the user having the obtained skin parameters belongs to a first skin type if the obtained skin parameters fall into a first parameters range; and determining the skin of the user having the obtained skin parameters belongs to a second skin type if the obtained skin parameters fall into a second parameters range.

8. The method according to claim 6, wherein querying a pre-stored relation list to determine a vibration mode associated to the determined skin type comprising:

determining that the skin of the user having the obtained skin parameters belongs to a first skin type;

upon such determination, determining a first vibration mode;

determining that the skin of the user having the obtained skin parameters belongs to a second skin type; and upon such determination, determining a second vibration mode.

9. The method according to claim 6, further comprising:

polling a temperature sensor of the electronic device by a preset frequency to obtain a temperature of the skin measured by the temperature sensor in real-time;

determining that the obtained temperature is greater than a preset temperature; and upon such determination, controlling the vibration motor to stop vibrating.

10. The method according to claim 6, wherein the multiple vibration modes define different vibration frequencies and different accelerations for the vibration motor.

11. A non-transitory storage medium having stored thereon instructions that, when executed by a processor of an electronic device, causes the processor to perform a method for skin care, the method comprising:

controlling a skin parameter detector to detect skin parameters of skin of a user, wherein the skin parameters comprise moisture, oil, and elasticity of the skin;

obtaining the skin parameters detected by the skin parameter detector;

determining a skin type of the skin according to the obtained skin parameters;

querying a pre-stored relation list to determine a vibration mode associated to the determined skin type, wherein the pre-stored relation list defines a relationship between multiple skin types and multiple vibration modes for a vibration motor; and controlling the vibration motor to work in the determined vibration mode to vibrate on the skin.

12. The non-transitory storage medium according to claim 11, wherein determining a skin type of the skin according to the obtained skin parameters comprising:

determining the skin of the user having the obtained skin parameters belongs to a first skin type if the obtained skin parameters fall into a first parameters range; and determining the skin of the user having the obtained skin parameters belongs to a second skin type if the obtained skin parameters fall into a second parameters range.

13. The non-transitory storage medium according to claim 11, wherein querying a pre-stored relation list to determine a vibration mode associated to the determined skin type comprising:

determining that the skin of the user having the obtained skin parameters belongs to a first skin type;

upon such determination, determining a first vibration mode;

determining that the skin of the user having the obtained skin parameters belongs to a second skin type; and upon such determination, determining a second vibration mode.

14. The non-transitory storage medium according to claim 11, wherein the method further comprising:

polling a temperature sensor of the electronic device by a preset frequency to obtain a temperature of the skin measured by the temperature sensor in real-time;

determining that the obtained temperature is greater than a preset temperature; and upon such determination, controlling the vibration motor to stop vibrating.

15. The non-transitory storage medium according to claim 11, wherein the multiple vibration modes define different vibration frequencies and different accelerations for the vibration motor.

* * * * *